US009550962B2

(12) United States Patent
Labeque et al.

(10) Patent No.: US 9,550,962 B2
(45) Date of Patent: Jan. 24, 2017

(54) STABLE NON-AQUEOUS LIQUID COMPOSITIONS COMPRISING A CATIONIC POLYMER IN PARTICULATE FORM

(71) Applicant: The Procter & Gamble Company, Cincinnati, OH (US)

(72) Inventors: Regine Labeque, Neder Over Heembeek (BE); Rajaë Boulaich, Antwerpen-Borgerhout (BE); Marc Jennewein, Taunusstein (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/535,345

(22) Filed: Nov. 7, 2014

(65) Prior Publication Data

US 2015/0065411 A1 Mar. 5, 2015

Related U.S. Application Data

(63) Continuation of application No. 13/159,445, filed on Jun. 14, 2011, now Pat. No. 8,895,493.

(30) Foreign Application Priority Data

Jun. 24, 2010 (EP) ..... 10167227

(51) Int. Cl.

| | |
|---|---|
| ***C11D 3/37*** | (2006.01) |
| ***C11D 1/00*** | (2006.01) |
| ***C11D 3/22*** | (2006.01) |
| ***C11D 3/43*** | (2006.01) |
| ***C11D 17/00*** | (2006.01) |
| ***C11D 17/04*** | (2006.01) |

(52) U.S. Cl.

CPC ..... *C11D 1/008* (2013.01); *C11D 3/227* (2013.01); *C11D 3/3707* (2013.01); *C11D 3/3723* (2013.01); *C11D 3/3773* (2013.01); *C11D 3/43* (2013.01); *C11D 17/0004* (2013.01); *C11D 17/043* (2013.01)

(58) Field of Classification Search

CPC ..... C11D 1/008; C11D 3/43; C11D 3/3703

See application file for complete search history.

(56) References Cited

U.S. PATENT DOCUMENTS

| | | | |
|---|---|---|---|
| 2,438,091 | A | 3/1948 | Lynch |
| 2,528,378 | A | 10/1950 | Mannheimer |
| 2,658,072 | A | 11/1953 | Kosmin |
| 3,915,903 | A | 10/1975 | Wise |
| 3,929,678 | A | 12/1975 | Laughlin et al. |
| 4,234,627 | A | 11/1980 | Schilling |
| 4,332,713 | A | 6/1982 | Lehmann |
| 4,514,461 | A | 4/1985 | Woo |
| 4,565,647 | A | 1/1986 | Llenado |
| RE32,713 | E | 7/1988 | Woo |
| 4,844,821 | A | 7/1989 | Mermelstein et al. |
| 4,882,200 | A | 11/1989 | Liu et al. |
| 4,882,220 | A | 11/1989 | Ono et al. |
| 4,917,920 | A | 4/1990 | Ono et al. |
| 5,225,112 | A | 7/1993 | Miyazawa et al. |
| 5,714,457 | A | 2/1998 | Kitsuki et al. |
| 5,942,217 | A | 8/1999 | Woo et al. |
| 5,955,093 | A | 9/1999 | Woo et al. |
| 5,968,404 | A | 10/1999 | Trinh et al. |
| 6,033,679 | A | 3/2000 | Woo et al. |
| 6,093,769 | A | 7/2000 | Burdick et al. |
| 6,106,738 | A | 8/2000 | Woo et al. |
| 6,126,954 | A | 10/2000 | Tsaur |
| 6,200,949 | B1 | 3/2001 | Reijmer et al. |
| 6,579,839 | B2 | 6/2003 | Price et al. |
| 6,645,479 | B1 | 11/2003 | Shefer et al. |
| 6,740,631 | B2 | 5/2004 | Shefer et al. |
| 6,787,512 | B1 | 9/2004 | Verrall et al. |
| 6,949,498 | B2 | 9/2005 | Murphy et al. |
| 6,995,126 | B2 | 2/2006 | Perkis et al. |
| 7,053,034 | B2 | 5/2006 | Shefer et al. |
| 7,125,835 | B2 | 10/2006 | Bennett et al. |
| 7,196,049 | B2 | 3/2007 | Brain et al. |
| 7,238,655 | B2 | 7/2007 | Ness |
| 7,585,824 | B2 | 9/2009 | Popplewell et al. |
| 7,718,596 | B2 | 5/2010 | Briggs et al. |
| 7,723,284 | B2 | 5/2010 | Mane et al. |
| 7,737,103 | B2 | 6/2010 | Hloucha et al. |
| 7,799,752 | B2 | 9/2010 | Ness et al. |
| 2002/0187909 | A1 | 12/2002 | Gupta et al. |
| 2003/0114332 | A1 | 6/2003 | Ramcharan et al. |
| 2003/0158344 | A1 | 8/2003 | Rodriques et al. |
| 2003/0165692 | A1 | 9/2003 | Koch et al. |
| 2003/0203829 | A1 | 10/2003 | Shefer et al. |
| 2003/0215417 | A1 | 11/2003 | Uchiyama et al. |
| 2003/0216488 | A1 | 11/2003 | Uchiyama et al. |
| 2004/0071742 | A1 | 4/2004 | Popplewell et al. |

(Continued)

FOREIGN PATENT DOCUMENTS

| | | | |
|---|---|---|---|
| EP | 0686691 | B1 | 8/2001 |
| EP | 2399978 | A1 | 12/2011 |
| WO | WO-89/09259 | A1 | 10/1989 |
| WO | WO 97/00936 | A1 | 1/1997 |
| WO | WO-98/08940 | A1 | 3/1998 |
| WO | WO-2007/107215 | A1 | 9/2007 |
| WO | WO-2007/120547 | A1 | 10/2007 |
| WO | WO-2009/087034 | A1 | 7/2009 |

*Primary Examiner* — John Hardee

(74) *Attorney, Agent, or Firm* — Gregory S. Darley-Emerson; Lenoard W Lewis; Steven W Miller

(57) ABSTRACT

The need for a stable, compact composition providing improved fabric care benefit, that is also convenient to use, can be met by incorporating a cationic cellulose polymer into a non-aqueous composition, using a non-aqueous dispersant. Such compositions have good physical stability, with little or no clumping of the cationic polymer in particulate form.

21 Claims, No Drawings

(56) References Cited

U.S. PATENT DOCUMENTS

| | | | |
|---|---|---|---|
| 2004/0087477 | A1 | 5/2004 | Ness |
| 2004/0106536 | A1 | 6/2004 | Mane et al. |
| 2004/0142840 | A1 | 7/2004 | De Buzzaccarini et al. |
| 2004/0152616 | A1 | 8/2004 | Murphy et al. |
| 2005/0076936 | A1 | 4/2005 | Pung et al. |
| 2005/0081888 | A1 | 4/2005 | Pung et al. |
| 2005/0124528 | A1 | 6/2005 | Binder et al. |
| 2006/0019866 | A1 | 1/2006 | Briggs et al. |
| 2006/0030513 | A1 | 2/2006 | Binder et al. |
| 2006/0160921 | A1 | 7/2006 | Ragone et al. |
| 2006/0292184 | A1 | 12/2006 | Richardson et al. |
| 2007/0107151 | A1 | 5/2007 | Pung et al. |
| 2008/0242579 | A1 | 10/2008 | Briggs et al. |
| 2009/0069207 | A1 | 3/2009 | Panandiker et al. |
| 2009/0071369 | A1 | 3/2009 | Ragone et al. |
| 2009/0124528 | A1 | 5/2009 | Danziger et al. |
| 2009/0172895 | A1 | 7/2009 | Lant et al. |
| 2009/0209445 | A1 | 8/2009 | Panandiker et al. |
| 2010/0192986 | A1 | 8/2010 | Brooker et al. |
| 2010/0313360 | A1 | 12/2010 | Menting et al. |
| 2011/0319310 | A1 | 12/2011 | Labeque et al. |
| 2011/0319311 | A1 | 12/2011 | Labeque et al. |
| 2011/0319314 | A1 | 12/2011 | Labeque et al. |
| 2012/0167150 | A1 | 6/2012 | Le Scouarnec et al. |

STABLE NON-AQUEOUS LIQUID COMPOSITIONS COMPRISING A CATIONIC POLYMER IN PARTICULATE FORM

This is a continuation of U.S. patent application Ser. No. 13/159,445, filed Jun. 14, 2011, now U.S. Pat. No. 8,895,493.

FIELD OF THE INVENTION

The present invention relates to stable, easy to pour, non-aqueous liquid compositions that deliver good fabric care benefit. The invention also relates to a process for stably suspending cationic polymers in non-aqueous liquid compositions.

BACKGROUND OF THE INVENTION

Today's consumers desire an easy to use laundry product with improved fabric care benefits,
including: improved softness, reduced fabric wrinkles, less mechanical damage during washing, less pills/fuzz, and less colour transfer or fading. Cationic polymers are known in the Art for providing improved fabric care, particularly softness and better fabric feel. Therefore, there is a strong desire to add these polymers to liquid compositions, including compact compositions, and unit dose liquid laundry articles.

As liquid laundry compositions become more and more compact, it is desirable to reduce or eliminate those ingredients that do not improve performance, including water. However, certain ingredients, such as cationic polymers are difficult to solubilise when little or no water is present. Also, these ingredients increase the composition viscosity to unacceptable levels at low water concentrations. Various means have been attempted to overcome this problem. Pre-dissolving the cationic polymer with low amounts of water leads to very viscous premixes that are difficult to process. WO 2007/107215 discloses a process whereby, a cationic cellulosic polymer is initially dissolved in water and optionally, a solvent. In addition, it has recently been discovered that for unit dose articles, cationic polymers can complex with the encapsulating water-soluble or dispersible film, which are generally anionically charged. This leads to poor film solubility.

Accordingly, a need remains for a means to stably incorporate such cationic polymers into non-aqueous liquid compositions. A need also remains, for a means of stably incorporate cationic polymers into liquid-comprising unit dose articles, without affecting the solubility of the enclosing film.

SUMMARY OF THE INVENTION

According to the present invention, there is provided a non-aqueous liquid composition comprising: a cationic polymer in particulate form; and a non-aqueous dispersant; wherein the cationic polymer is stably dispersed in the non-aqueous liquid composition. The present invention also provides for a process for preparing the non-aqueous liquid composition, characterized in that the process comprises the steps of: providing a cationic polymer dispersion by combining the cationic polymer with the dispersant; and combining the cationic polymer dispersion with a non-aqueous liquid feed.

DETAILED DESCRIPTION OF THE INVENTION

The present invention solves the problem of providing stable, low water, liquid compositions comprising cationic polymers. It has surprisingly been found that the problem of solubilising cationic polymers in such compositions can be avoided, by creating a stable suspension of the cationic polymer in particulate form in the non-aqueous composition. Without the addition of a non-aqueous dispersant, the cationic polymer particles are extremely difficult to distribute uniformly throughout the non-aqueous composition. In addition, the particulate dispersion is unstable, having a tendency to settle and form cakes or clumps that are extremely difficult to redisperse. By using a non-aqueous dispersant to distribute the cationic polymer particles, the need for highly viscous polymer premixes is also avoided. It has also been found that the addition of a non-aqueous dispersant improves the physical stability of the cationic polymer dispersion in the final composition. In such compositions, if cakes or clumps do form, they can be redistributed by simple shaking. For instance, shaking equivalent to the agitation one would expect from dispensing during use, or the agitation of unit dose articles during the initial phase of a wash. If the cationic polymer particles are partially hydrated or solvated, such clumps are even easier to redisperse. Partially hydrated or solvated particles are those that comprise water and/or another solvent at levels that are insufficient to cause the particles to fully solubilise. In liquid containing unit dose articles, having the cationic polymer in particulate form inhibits them from reducing the solubility of the water soluble or dispersible film, since the cationic polymer is unable to complex with the film.

All percentages, ratios and proportions used herein are by weight percent of the non-aqueous liquid composition. When referring to unit dose articles, all percentages, ratios and proportions used herein are by weight percent of the contents of the unit dose compartment. That is, excluding the weight of the encapsulating material. For multi-compartment unit dose articles, percentages, ratios and proportions used herein, are by weight percent of the contents of the individual unit dose compartment, unless otherwise specified.

Non-Aqueous Liquid Compositions:

As used herein, "non-aqueous liquid composition" refers to any liquid composition comprising less than 20%, preferably less than 15%, more preferably less than 12%, most preferably less than 8% by weight of water. For instance, containing no additional water beyond what is entrained with other constituent ingredients. The term liquid also includes viscous forms such as gels and pastes. The non-aqueous liquid may include other solids or gases in suitably subdivided form, but excludes forms which are non-liquid overall, such as tablets or granules. The non-aqueous composition of the present invention may also comprise from 2% to 40%, more preferably from 5% to 25% by weight of a non-aqueous solvent. As used herein, "non-aqueous solvent" refers to any organic solvent which contains no amino functional groups. Preferred non-aqueous solvents include monohydric alcohols, dihydric alcohols, polyhydric alcohols, glycerol, glycols including polyalkylene glycols such as polyethylene glycol, and mixtures thereof. More preferred non-aqueous solvents include monohydric alcohols, dihydric alcohols, polyhydric alcohols, glycerol, and mixtures thereof. Highly preferred are mixtures of solvents, especially mixtures of two or more of the following: lower aliphatic alcohols such as ethanol, propanol, butanol, isopropanol;

diols such as 1,2-propanediol or 1,3-propanediol; and glycerol. Also preferred are propanediol and mixtures thereof with diethylene glycol, where the mixture contains no methanol or ethanol. Thus embodiments of non-aqueous liquid compositions of the present invention may include embodiments in which propanediols are used but methanol and ethanol are not used.

Preferable non-aqueous solvents are liquid at ambient temperature and pressure (i.e. 21° C. and 1 atmosphere), and comprise carbon, hydrogen and oxygen. Non-aqueous solvents may be present when preparing a premix, or in the final non-aqueous composition.

Cationic Polymer in Particulate Form:

The non-aqueous liquid compositions of the present invention may comprise from 0.01% to 20%, preferably from 0.1% to 15%, more preferably from 0.6% to 10% by weight of the cationic polymer in particulate form. That is, the cationic polymer is insoluble in the non-aqueous liquid composition, or does not fully dissolve in the non-aqueous liquid composition.

The cationic polymer particles preferably have an area average D90 diameter of less than 300 microns, preferably less than 200 microns, more preferably less than 150 microns. The area average D90 diameter is defined as 90% of the particles having an area smaller than the area of a circle having the diameter D90. The method for measuring the particle size is given in the Test Methods. The cationic polymer particles are preferably as small as possible. Having smaller particles result in faster dissolution, particularly at lower temperatures, making such particles particularly suitable for providing fabric care benefit during low temperature fabric treatments.

Suitable particulate forms include solids that are completely free of water and/or other solvent, but also includes solids that are partially hydrated and/or solvated. A benefit of partially hydrating and/or solvating the cationic polymer is that if any agglomerates form, they have low cake strength and are easy to redisperse. Such hydrated or solvated particles generally comprise from 0.5% to 50%, preferably 1% to 20% of water or solvent. While water is preferred, any solvent that is capable of partially solvating the cationic polymer may be used.

The cationic polymer preferably has a cationic charge density of from 0.005 to 23, more preferably from 0.01 to 12, most preferably from 0.1 to 7 milliequivalents/g, at the pH of the non-aqueous liquid composition. The charge density is calculated by dividing the number of net charges per repeating unit by the molecular weight of the repeating unit. The positive charges could be located on the backbone of the polymer and/or the side chains of polymer.

The term "cationic polymer" also includes amphoteric polymers that have a net cationic charge at the pH of the non-aqueous composition. Non-limiting examples of suitable cationic polymers are polysaccharides, proteins and synthetic polymers. Cationic polysaccharides include cationic cellulose derivatives, cationic guar gum derivatives, chitosan and derivatives, and cationic starches. Suitable cationic polysaccharides include cationically modified cellulose, particularly cationic hydroxyethylcellulose and cationic hydroxypropylcellulose. Preferred cationic celluloses for use herein include those which may or may not be hydrophobically-modified, including those having hydrophobic substituent groups, having a molecular weight of from 50,000 to 2,000,000, more preferably from 100,000 to 1,000,000, and most preferably from 200,000 to 800,000.

These cationic materials have repeating substituted anhydroglucose units that correspond to the general Structural Formula I as follows:

Structural Formula I

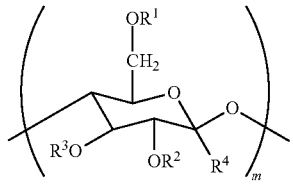

wherein:

a. m is an integer from 20 to 10,000 b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

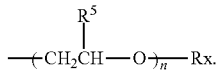

Preferably, $R^1$, $R^2$, $R^3$ are each independently selected from the group consisting of: H; and $C_1$-$C_4$ alkyl;

wherein:

n is an integer selected from 0 to 10 and

Rx is selected from the group consisting of: $R_5$;

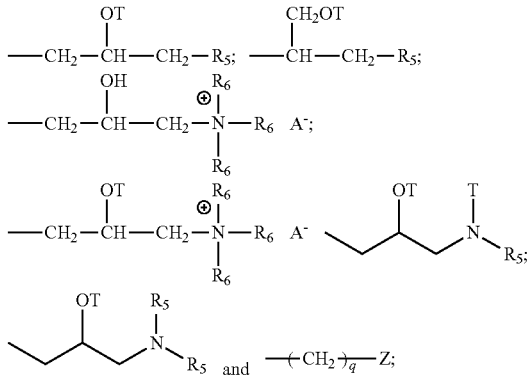

wherein at least one Rx in said polysaccharide has a structure selected from the group consisting of:

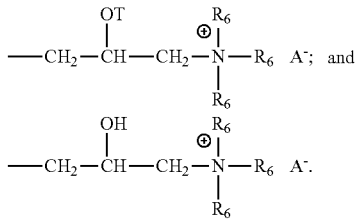

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group: H,

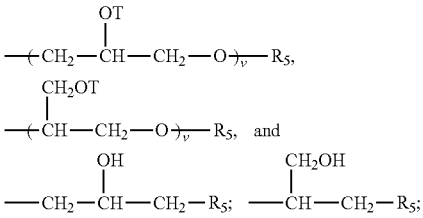

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

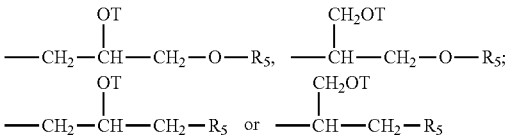

group in a chain, T is always an H.

Alkyl substitution on the anhydroglucose rings of the polymer may range from 0.01% to 5% per glucose unit, more preferably from 0.05% to 2% per glucose unit, of the polymeric material.

The cationic cellulose may be lightly cross-linked with a dialdehyde, such as glyoxyl, to prevent forming lumps, nodules or other agglomerations when added to water at ambient temperatures.

The cationic cellulose ethers of Structural Formula I likewise include those which are commercially available and further include materials which can be prepared by conventional chemical modification of commercially available materials. Commercially available cellulose ethers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67. Suitable cationic galactomannans include cationic guar gums or cationic locust bean gum. An example of a cationic guar gum is a quaternary ammonium derivative of Hydroxypropyl Guar such as those sold under the trade name: Jaguar C13 and Jaguar Excel available from Rhodia, Inc of Cranbury N.J. and N-Hance by Aqualon, Wilmington, Del.

A synthetic cationic polymer may also be useful as the cationic polymer. Synthetic polymers include synthetic addition polymers of the general structure:

Structural Formula II

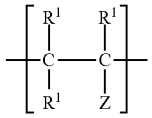

wherein each $R^1$ may be independently: hydrogen, $C_1$-$C_{12}$ alkyl, substituted or unsubstituted phenyl, substituted or unsubstituted benzyl, —$OR_a$, or —$C(O)OR_a$ wherein $R_a$ may be selected from the group consisting of: hydrogen, $C_1$-$C_{24}$ alkyl, and combinations thereof. $R^1$ is preferably: hydrogen, $C_1$-$C_4$ alkyl, or —$OR_a$, or —$C(O)OR_a$;

wherein each $R^2$ may be independently selected from the group consisting of: hydrogen, hydroxyl, halogen, $C_1$-$C_{12}$ alkyl, —$OR_a$, substituted or unsubstituted phenyl, substituted or unsubstituted benzyl, carbocyclic, heterocyclic, and combinations thereof. $R^2$ is preferably selected from the group consisting of: hydrogen, $C_1$-$C_4$ alkyl, and combinations thereof.

Each Z may be independently: hydrogen, halogen; linear or branched $C_1$-$C_{30}$ alkyl, nitrilo, $N(R_3)_2$—$C(O)N(R_3)_2$; —NHCHO (formamide); —$OR^3$, —$O(CH_2)_nN(R^3)_2$, —$O(CH_2)_nN^+(R^3)_3X^-$, —$C(O)OR^4$; —$C(O)N$—$(R^3)_2$; —$C(O)O(CH_2)_nN(R^3)_2$, —$C(O)O(CH_2)_nN^+(R^3)_3X^-$, —$OCO(CH_2)_nN(R^3)_2$, —$OCO(CH_2)_nN^+(R^3)_3X^-$, —$C(O)NH$—$(CH_2)_nN(R^3)_2$, —$C(O)NH(CH_2)_nN^+(R^3)_3X^-$, —$(CH_2)_nN(R^3)_2$, —$(CH_2)_nN^+(R^3)_3X^-$.

Each $R_3$ may be independently selected from the group consisting of: hydrogen, $C_1$-$C_{24}$ alkyl, $C_2$-$C_8$ hydroxyalkyl, benzyl, substituted benzyl, and combinations thereof;

Each $R_4$ may be independently selected from the group consisting of: hydrogen, $C_1$-$C_{24}$ alkyl,

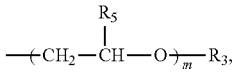

and combinations thereof.

X may be a water soluble anion. n may be from 1 to 6.

$R_5$ may be independently selected from the group consisting of: hydrogen, $C_1$-$C_6$ alkyl, and combinations thereof.

Z, from Structural Formula II, may also be selected from the group consisting of: non-aromatic nitrogen heterocycles containing a quaternary ammonium ion, heterocycles containing an N-oxide moiety, aromatic nitrogens containing heterocycles wherein one or more or the nitrogen atoms may be quaternized; aromatic nitrogen-containing heterocycles wherein at least one nitrogen may be an N-oxide, and combinations thereof. Non-limiting examples of addition polymerizing monomers comprising a heterocyclic Z unit includes 1-vinyl-2-pyrrolidinone, 1-vinylimidazole, quaternized vinyl imidazole, 2-vinyl-1, 3-dioxolane, 4-vinyl-1-cyclohexenel, 2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ, may be the —NHCHO unit, formamide. The formulator can prepare a polymer, or co-polymer, comprising formamide units some of which are subsequently hydrolyzed to form vinyl amine equivalents.

The polymers or co-polymers may also contain one or more cyclic polymer units derived from cyclically polymerizing monomers. An example of a cyclically polymerizing monomer is dimethyl diallyl ammonium having the formula:

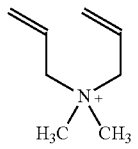

Suitable copolymers may be made from one or more cationic monomers selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, maleic acid, vinyl sulfonic acid, styrene sulfonic acid, acrylamidopropylmethane sulfonic acid (AMPS) and their salts, and combinations thereof. The polymer may optionally be cross-linked. Suitable crosslinking monomers include ethylene glycoldiacrylate, divinylbenzene, butadiene.

In certain embodiments, the synthetic polymers are: poly (acrylamide-co-diallyldimethylammonium chloride), poly (acrylamide-methacrylamidopropyltrimethyl ammonium chloride), poly(acrylamide-co-N,N-dimethylaminoethyl methacrylate), poly(acrylamide-co-N,N-dimethylaminoethyl methacrylate), poly(hydroxyethylacrylate-co-dimethylaminoethyl methacrylate), poly(hydroxpropylacrylate-co-dimethylaminoethyl methacrylate), poly (hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid). Examples of other suitable synthetic polymers are Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33. Other cationic polymers include polyethyleneamine and its derivatives and polyamidoamine-epichlorohydrin (PAE) Resins. In one aspect, the polyethylene derivative may be an amide derivative of polyetheylenimine sold under the trade name Lupasol SK. Also included are alkoxylated polyethylenimine; alkyl polyethyleneimine and quaternized polyethyleneimine. These polymers are described in Wet Strength resins and their applications edited by L. L. Chan, TAPPI Press (1994). The weight-average molecular weight of the polymer will generally be from 10,000 to 5,000,000, or from 100,000 to 200,000, or from 200,000 to 1,500,000 Daltons, as determined by size exclusion chromatography relative to polyethylene oxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 mL/min.

Non-Aqueous Dispersant:

The non-aqueous composition of the present invention includes a non-aqueous dispersant which distributes the cationic polymer throughout the non-aqueous composition. The non-aqueous liquid composition may comprise from 0.05% to 98%, preferably from 0.5% to 75%, more preferably from 3% to 50% by weight of the non-aqueous dispersant. Surprisingly, it has been found that the non-aqueous dispersant also greatly improves the physical stability of the cationic polymer particulates in the non-aqueous composition. In addition, having the non-aqueous dispersant present results in any agglomerates that may form over time, being easily redistributed by gentle shaking. Suitable dispersants include non-aqueous dispersants having a Hansen solubility parameter of from 23 to 36, preferably from 27 to 29. The method of calculating the Hansen solubility parameter is given in the Test Methods. Particularly preferable are alcohols or polyols selected from the group consisting of: ethanol, glycerol, polyethylene glycol of molecular weight from 100 to 400. While polyethylene glycols of molecular weight 100 to 400 may be considered as suitable non-aqueous solvents, if present, they are present as non-aqueous dispersants.

The strength of any agglomerates that may form is further reduced by adding spacer particles. Suitable spacer particles may have an area average D90 diameter of less than 5 microns, preferably from 0.1 microns to 1 micron. The spacer particles may be polymeric or non-polymeric. Suitable non-polymeric spacer particles include mica. Suitable polymeric spacer particles include those comprising a polymer and/or a copolymer. Preferably, the spacer particles are anionically charged, such as those comprising a polyacrylate polymer or copolymer. It is believed that the anionic charge attracts the spacer particle to the cationic polymer particles. The non-aqueous composition of the present invention may comprise from 0.1% to 30%, preferably from 0.5 percent to 15% by weight of the spacer particles.

Any present agglomerates of the cationic polymer particles may also be weakened by the presence of soluble cations and/or polyvalent anions. While polyvalent cations, particularly those having the charges derived from different charged groups are preferred, even monovalent cations have been shown to provide a benefit. It is believed that the cations form bilayers that are able to reduce the attraction between the cationic polymer particles. Suitable single species polyvalent cations include the cations of magnesium and calcium. Suitable cationic surfactants are preferably water-soluble, but can also be water-dispersible or water-insoluble. Such cationic surfactants have at least one quaternized nitrogen and at least one long-chain hydrocarbyl group. Compounds comprising two, three or even four long-chain hydrocarbyl groups are also included. Examples include alkyltrimethylammonium salts, such as C12 alkyltrimethylammonium chloride, or their hydroxyalkyl substituted analogues. The present invention may comprise from 1% or more by weight of the cationic surfactant. Amphoteric surfactants, particularly those that have a net cationic charge at the pH of the non-aqueous composition, are also useful cations for the present invention. Suitable polyvalent anions include: Citric Acid; Diethylene triamine pentaacetic acid (DTPA); 1-hydroxyethane 1,1-diphosphonic acid (HEDP); Maleic acid; Polyacrylates; Polyacrylic/maleic acid copolymers; succinic acid, and mixtures thereof. The non-aqueous composition may comprise from 0.1% to 30%, preferably from 0.5 to 15% by weight of the cation and/or polyvalent anion.

Laundering Adjuncts:

The non-aqueous liquid compositions of the present invention may include conventional laundry detergent ingredients selected from the group consisting of: anionic and nonionic surfactants; additional surfactants; enzymes; enzyme stabilizers; cleaning polymers, including: amphiphilic alkoxylated grease cleaning polymers, clay soil cleaning polymers, soil release polymers, and soil suspending polymers; bleaching systems; optical brighteners; hueing dyes; particulate material; perfume and other odour control agents; hydrotropes; suds suppressors; fabric care benefit agents; pH adjusting agents; dye transfer inhibiting agents; preservatives; non-fabric substantive dyes and mixtures thereof. Some of the optional ingredients which can be used are described in greater detail as follows:

Anionic and Nonionic Surfactants: Non-aqueous liquid compositions of the present invention may comprise from 1% to 70%, preferably from 10% to 50%, and more preferably from 15% to 45% by weight of an anionic and/or nonionic surfactant.

The non-aqueous liquid compositions of the present invention preferably comprise from 1 to 70%, more preferably from 5 to 50% by weight of one or more anionic surfactants. Preferred anionic surfactant are selected from the group consisting of: C11-C18 alkyl benzene sulfonates, C10-C20 branched-chain and random alkyl sulfates, C10-C18 alkyl ethoxy sulfates, mid-chain branched alkyl sulfates, mid-chain branched alkyl alkoxy sulfates, C10-C18 alkyl alkoxy carboxylates comprising 1-5 ethoxy units, modified alkylbenzene sulfonate, C12-C20 methyl ester sulfonate, C10-C18 alpha-olefin sulfonate, C6-C20 sulfosuccinates, and mixtures thereof. However, by nature, every anionic surfactant known in the art of detergent compositions may be used, such as those disclosed in "Surfactant Science Series", Vol. 7, edited by W. M. Linfield, Marcel Dekker. However, the compositions of the present invention preferably comprise at least one sulphonic acid surfactant, such as a linear alkyl benzene sulphonic acid, or the water-soluble salt forms.

Anionic sulfonate or sulfonic acid surfactants suitable for use herein include the acid and salt forms of linear or branched C5-C20, more preferably C10-C16, most preferably C11-C13 alkylbenzene sulfonates, C5-C20 alkyl ester sulfonates, C6-C22 primary or secondary alkane sulfonates, C5-C20 sulfonated polycarboxylic acids, and mixtures thereof. The aforementioned surfactants can vary widely in their 2-phenyl isomer content. Anionic sulphate salts suitable for use in compositions of the invention include: primary and secondary alkyl sulphates, having a linear or branched alkyl or alkenyl moiety having from 9 to 22 carbon atoms, more preferably from 12 to 18 carbon atoms; beta-branched alkyl sulphate surfactants; and mixtures thereof. Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used. Other suitable anionic surfactants for use herein include fatty methyl ester sulphonates and/or alkyl ethoxy sulphates (AES) and/or alkyl polyalkoxylated carboxylates (AEC). Mixtures of anionic surfactants can be used, for example mixtures of alkylbenzenesulphonates and AES.

The anionic surfactants are typically present in the form of their salts with alkanolamines or alkali metals such as sodium and potassium. Preferably, the anionic surfactants are neutralized with alkanolamines, such as monoethanolamine or triethanolamine, and are fully soluble in the non-aqueous liquid composition.

The non-aqueous liquid compositions of the present invention may include from 1 to 70%, preferably from 5 to 50% by weight of a nonionic surfactant. Suitable nonionic surfactants include, but are not limited to C12-C18 alkyl ethoxylates ("AE") including the so-called narrow peaked alkyl ethoxylates, C6-C12 alkyl phenol alkoxylates (especially ethoxylates and mixed ethoxylates/propoxylates), block alkylene oxide condensate of C6-C12 alkyl phenols, alkylene oxide condensates of C8-C22 alkanols and ethylene oxide/propylene oxide block polymers (Pluronic®-BASF Corp.), as well as semi polar nonionics (e.g., amine oxides and phosphine oxides). An extensive disclosure of suitable nonionic surfactants can be found in U.S. Pat. No. 3,929,678.

Alkylpolysaccharides such as disclosed in U.S. Pat. No. 4,565,647 are also useful nonionic surfactants for compositions of the invention. Also suitable are alkyl polyglucoside surfactants. In some embodiments, suitable nonionic surfactants include those of the formula $R1(OC_2H_4)_nOH$, wherein R1 is a C10-C16 alkyl group or a C8-C12 alkyl phenyl group, and n is from 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol. Additional suitable nonionic surfactants include polyhydroxy fatty acid amides of the formula:

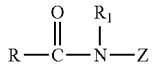

wherein R is a C9-C17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide.

Additional Surfactants: The non-aqueous liquid compositions of the present invention may comprise additional surfactant selected from the group consisting: anionic, cationic, nonionic, amphoteric and/or zwitterionic surfactants and mixtures thereof.

Amphoteric detersive surfactants suitable for use in the composition include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulphonate, sulphate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Zwitterionic detersive surfactants suitable for use in non-aqueous liquid compositions are well known in the art, and include those surfactants broadly described as derivatives of aliphatic quaternary ammonium, phosphonium, and sulphonium compounds, in which the aliphatic radicals can be straight or branched chain, and wherein one of the aliphatic substituents contains from 8 to 18 carbon atoms and one contains an anionic group such as carboxy, sulfonate, sulphate, phosphate or phosphonate. Zwitterionics such as betaines are also suitable for this invention. Furthermore, amine oxide surfactants having the formula: $R(EO)_x(PO)_y(BO)_zN(O)(CH_2R')_2.qH2O$ are also useful in compositions of the present invention. R is a relatively long-chain hydrocarbyl moiety which can be saturated or unsaturated, linear or branched, and can contain from 8 to 20, preferably from 10 to 16 carbon atoms, and is more preferably C12-C16 primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by C12-C14 alkyldimethyl amine oxide.

Non-limiting examples of other anionic, zwitterionic, amphoteric or optional additional surfactants suitable for use in the compositions are described in McCutcheon's, Emulsifiers and Detergents, 1989 Annual, published by M. C. Publishing Co., and U.S. Pat. Nos. 3,929,678, 2,658,072; 2,438,091; 2,528,378.

Enzymes: The non-aqueous liquid compositions of the present invention may comprise from 0.0001% to 8% by weight of a detersive enzyme which provides cleaning performance and/or fabric care benefits. Such compositions preferably have a composition pH of from 6 to 10.5. Suitable enzymes can be selected from the group consisting of: lipase, protease, amylase, cellulase, mannanase, pectate lyase, xyloglucanase, and mixtures thereof. A preferred enzyme combination comprises a cocktail of conventional detersive enzymes such as lipase, protease, cellulase and amylase. Detersive enzymes are described in greater detail in U.S. Pat. No. 6,579,839.

Enzyme Stabilizers: Enzymes can be stabilized using any known stabilizer system such as calcium and/or magnesium compounds, boron compounds and substituted boric acids, aromatic borate esters, peptides and peptide derivatives, polyols, low molecular weight carboxylates, relatively hydrophobic organic compounds [e.g. certain esters, dialkyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl)serine salts; (meth)acrylic acid-(meth)acrylic acid ester copolymer and PEG; lignin compound, polyamide oligomer, glycolic acid or its salts; poly hexamethylene biguanide or N,N-bis-3-amino-propyl-dodecyl amine or salt; and mixtures thereof.

Fabric Care Benefit Agents: The non-aqueous composition may comprise from 1% to 15%, more preferably from 2% to 7%, by weight of a fabric care benefit agent. "Fabric care benefit agent", as used herein, refers to any material that can provide fabric care benefits. Non-limiting examples of fabric care benefits include, but are not limited to: fabric softening, colour protection, colour restoration, pill/fuzz reduction, anti-abrasion and anti-wrinkling. Non-limiting examples of fabric care benefit agents include: silicone derivatives, such as polydimethylsiloxane and amino-functional silicones; oily sugar derivatives; dispersible polyolefins; polymer latexes; cationic surfactants and combinations thereof.

Cleaning Polymers: The non-aqueous liquid compositions herein, may contain from 0.01% to 10%, preferably from 0.05% to 5%, more preferably from 0.1% to 2.0% by weight of cleaning polymers, that provide for broad-range soil cleaning of surfaces and fabrics. Any suitable cleaning polymer may be of use. Useful cleaning polymers are described in US 2009/0124528A1. Non-limiting examples of useful categories of cleaning polymers include: amphiphilic alkoxylated grease cleaning polymers; clay soil cleaning polymers; soil release polymers; and soil suspending polymers. Other anionic polymers, useful for improving soil cleaning include: non-silicone-containing polymers of natural origin, but also of synthetic origin. Suitable anionic non-silicone-containing polymers may be selected from the group consisting of xanthan gum, anionic starch, carboxymethyl guar, carboxymethyl hydroxypropyl guar, carboxy methyl cellulose and ester modified carboxymethyl cellulose, N-carboxyalkyl chitosan, N-carboxyalkyl chitosan amides, pectin, carrageenan gum, chondroitin sulfate, galactomanans, hyaluronic acid-, and alginic acid-based polymers, and derivatives thereof and mixtures thereof. More preferably, the anionic non-silicone-containing polymer maybe selected from carboxymethyl guar, carboxymethyl hydroxypropyl guar, carboxymethyl cellulose and xanthan gum, and derivatives and mixtures thereof. Preferred anionic non-silicone-containing polymers include those commercially available from CPKelco, sold under the tradename of Kelzan® RD and from Aqualon, sold under the tradename of Galactosol® SP722S, Galactosol® 60H3FD, and Galactosol® 70H4FD.

Optical Brighteners: These are also known as fluorescent whitenening agents for textiles. Preferred levels are from 0.001% to 2% by weight of the non-aqueous liquid composition. Suitable brighteners are disclosed in EP 686691B and include hydrophobic as well as hydrophilic types. Brightener 49 is preferred for use in the present invention.

Hueing Dyes: Hueing dyes or fabric shading dyes are useful laundering adjuncts in non-aqueous liquid compositions. Suitable dyes include blue and/or violet dyes having a hueing or shading effect. See, for example, WO 2009/087524 A1, WO2009/087034A1 and references therein. Recent developments that are suitable for the present invention include sulfonated phthalocyanine dyes having a zinc or aluminium central atom. The non-aqueous liquid compositions herein may comprise from 0.00003% to 0.1%, preferably from 0.00008% to 0.05% by weight of the fabric hueing dye.

Particulate Material: The non-aqueous composition may include additional particulate material such as clays, suds suppressors, encapsulated oxidation-sensitive and/or thermally sensitive ingredients such as perfumes (perfume microcapsules), bleaches and enzymes; or aesthetic adjuncts such as pearlescent agents including mica, pigment particles, or the like. Suitable levels are from 0.0001% to 10%, or from 0.1% to 5% by weight of the non-aqueous composition.

Perfume and Other Odour Control Agents: In preferred embodiments, the non-aqueous composition comprises a free and/or micro-encapsulated perfume. If present, the free perfume is typically incorporated at a level from 0.001% to 10%, preferably from 0.01% to 5%, more preferably from 0.1% to 3% by weight of the non-aqueous composition.

If present, the perfume microcapsule is formed by at least partially surrounding the perfume raw materials with a wall material. Preferably, the microcapsule wall material comprises: melamine crosslinked with formaldehyde, polyurea, urea crosslinked with formaldehyde or urea crosslinked with gluteraldehyde. Suitable perfume microcapsules and perfume nanocapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. Nos. 6,645,479; 6,200,949; 4,882,220; 4,917,920; 4,514,461; U.S. RE 32713; U.S. Pat. No. 4,234,627.

In other embodiments, the non-aqueous composition comprises odour control agents such as uncomplexed cyclodextrin, as described in U.S. Pat. No. 5,942,217. Other suitable odour control agents include those described in: U.S. Pat. Nos. 5,968,404, 5,955,093, 6,106,738, 5,942,217, and 6,033,679.

Hydrotropes: The non-aqueous liquid composition of the present invention typically comprises a hydrotrope in an effective amount, preferably up to 15%, more preferably from 1% to 10%, most preferably from 3% to 6% by weight, so that the compositions are readily dispersed in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

Multivalent Water-Soluble Organic Builder and/or Chelant: The non-aqueous liquid compositions of the present invention may comprise from 0.6% to 25%, preferably from 1% to 20%, more preferably from 2% to 7% by weight of the multivalent water-soluble organic builder and/or chelants. Water-soluble organic builders provide a wide range of benefits including sequestration of calcium and magnesium (improving cleaning in hard water), provision of alkalinity, transition metal ion complexation, metal oxide colloid stabilisation, and provision of substantial surface charge for peptisation and suspension of other soils. Chelants may selectively bind transition metals (such as iron, copper and manganese) which impact stain removal and the stability of bleach ingredients, such as organic bleach catalysts, in the wash solution. Preferably, the multivalent water-soluble organic builder and/or chelants of the present invention are selected from the group consisting of: MEA citrate, citric acid, aminoalkylenepoly(alkylene phosphonates), alkali metal ethane 1-hydroxy disphosphonates, and nitrilotrimethylene, phosphonates, diethylene triamine penta (methylene phosphonic acid) (DTPMP), ethylene diamine tetra (methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine di-succinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), and mixtures thereof.

External Structuring System: The physical stability of the cationic polymer particulates in the non-aqueous liquid composition can be further improved if the non-aqueous liquid composition also comprises an external structurant. An external structuring system is a compound or mixture of compounds which provide either a sufficient yield stress or low shear viscosity to stabilize the non-aqueous liquid compositions independently from, or extrinsic from, the structuring effect of any detersive surfactants in the composition. The non-aqueous liquid composition may comprise from 0.01% to 10%, preferably from 0.1% to 4% by weight of an external structuring system. Suitable external structuring systems include non-polymeric crystalline, hydroxy-functional structurants, polymeric structurants, or mixtures thereof.

Preferably, the external structurant system imparts a high shear viscosity at 20 $s^{-1}$, at 21° C., of from 1 to 1500 cps, and a viscosity at low shear (0.05 $s^{-1}$ at 21° C.) of greater than 5000 cps. The viscosity is measured using an AR 550 rheometer, from TA instruments, using a plate steel spindle with a 40 mm diameter and a gap size of 500 μm. The high shear viscosity at 20 $s^{-1}$, and low shear viscosity at 0.5 $s^{-1}$, can be obtained from a logarithmic shear rate sweep from 0.1 $s^{-1}$ to 25 $s^{-1}$ in 3 minutes time at 21° C.

The external structuring system may comprise a non-polymeric crystalline, hydroxyl functional structurant. Such non-polymeric crystalline, hydroxyl functional structurants generally comprise a crystallisable glyceride which can be pre-emulsified to aid dispersion into the final non-aqueous composition. Preferred crystallisable glycerides include hydrogenated castor oil or "HCO", and derivatives thereof, provided that it is capable of crystallizing in the non-aqueous composition. Other embodiments of suitable external structuring systems may comprise a naturally derived and/or synthetic polymeric structurant. Examples of suitable naturally derived polymeric structurants include: hydroxyethyl cellulose, hydrophobically modified hydroxyethyl cellulose, carboxymethyl cellulose, polysaccharide derivatives, and mixtures thereof. Suitable polysaccharide derivatives include: pectine, alginate, arabinogalactan (gum Arabic), carrageenan, gellan gum, xanthan gum, guar gum, and mixtures thereof. Examples of suitable synthetic polymeric structurants include: polycarboxylates, polyacrylates, hydrophobically modified ethoxylated urethanes, hydrophobically modified non-ionic polyols and mixtures thereof.

The Unit Dose Article

Non-aqueous liquid compositions of the present invention may be comprised in unit dose articles, having at least one liquid filled compartment. A liquid-filled compartment refers to a partition of the unit dose article comprising a liquid capable of wetting a fabric e.g., clothing. Such unit dose articles comprise, in single, easy to use dosage form: a cationic polymer in particulate form, stably suspended in a non-aqueous composition by means of a non-aqueous dispersant, encapsulated in a water-soluble or dispersible film.

The unit dose article can be of any form, shape and material which is suitable for holding the non-aqueous composition, i.e. without allowing the release of the non-aqueous composition, and any additional component, from the unit dose article prior to contact of the unit dose article with water. The exact execution will depend, for example, on the type and amount of the compositions in the unit dose article, the number of compartments in the unit dose article, and on the characteristics required from the unit dose article to hold, protect and deliver or release the compositions or components.

The unit dose article comprises a water-soluble or dispersible film which fully encloses at least one inner volume, comprising the non-aqueous composition. The unit dose article may optionally comprise additional compartments comprising non-aqueous liquid and/or solid components. Alternatively, any additional solid component may be suspended in a liquid-filled compartment. A multi-compartment unit dose form may be desirable for such reasons as: separating chemically incompatible ingredients; or where it is desirable for a portion of the ingredients to be released into the wash earlier or later.

It may be preferred that any compartment which comprises a liquid component also comprises an air bubble. The air bubble may have a volume of less than 50%, preferably less than 40%, more preferably less than 30%, more preferably less than 20%, most preferably less than 10% of the volume space of said compartment. Without being bound by theory, it is believed that the presence of the air bubble increases the tolerance of the unit dose article to the movement of the liquid component within the compartment, thus reducing the risk of the liquid component leaking from the compartment.

Water-Soluble or Dispersible Film: The water-soluble or dispersible film typically has a solubility of at least 50%, preferably at least 75%, more preferably at least 95%. The method for determining water-solubility of the film is given in the Test Methods. The water-soluble or dispersible film typically has a dissolution time of less than 100 seconds, preferably less than 85 seconds, more preferably less than 75 seconds, most preferably less than 60 seconds. The method for determining the dissolution time of the film is given in the Test Methods.

Preferred films are polymeric materials, preferably polymers which are formed into a film or sheet. The film can be obtained by casting, blow-moulding, extrusion or blow extrusion of the polymer material, as known in the art. Preferably, the water-soluble or dispersible film comprises: polymers, copolymers or derivatives thereof, including polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum, and mixtures thereof. More preferably, the water-soluble or dispersible film comprises: polyacrylates and water-soluble acrylate copolymers, methylcellulose, carboxymethylcellulose, dextrin, ethylcellulose, hydroxyethyl cellulose, hydroxypropyl methylcellulose, maltodextrin, polymethacrylates, and mixtures thereof. Most preferably, the water-soluble or dispersible film comprises: polyvinyl alcohols, polyvinyl alcohol copolymers, hydroxypropyl methyl cellulose (HPMC), and mixtures thereof. Preferably, the level of polymer or copolymer in the film is at least 60% by weight. The polymer or copolymer preferably has a weight average molecular weight of from 1000 to 1,000,000, more preferably from 10,000 to 300,000, even more preferably form 15,000 to 200,000, and most preferably from 20,000 to 150,000.

Copolymers and mixtures of polymers can also be used. This may in particular be beneficial to control the mechanical and/or dissolution properties of the compartments or unit dose article, depending on the application thereof and the required needs. For example, it may be preferred that a mixture of polymers is present in the film, whereby one polymer material has a higher water-solubility than another polymer material, and/or one polymer material has a higher mechanical strength than another polymer material. Using copolymers and mixtures of polymers can have other benefits, including improved long-term resiliency of the water-soluble or dispersible film to the detergent ingredients. For instance, U.S. Pat. No. 6,787,512 discloses polyvinyl alcohol copolymer films comprising a hydrolyzed copolymer of vinyl acetate and a second sulfonic acid monomer, for improved resiliency against detergent ingredients. An example of such a film is sold by Monosol of Merrillville, Ind., US, under the brand name: M8900. It may be preferred that a mixture of polymers is used, having different weight average molecular weights, for example a mixture of polyvinyl alcohol or a copolymer thereof, of a weight average molecular weight of from 10,000 to 40,000, and of another polyvinyl alcohol or copolymer, with a weight average molecular weight of from 100,000 to 300,000.

Also useful are polymer blend compositions, for example comprising hydrolytically degradable and water-soluble polymer blends such as polylactide and polyvinyl alcohol, achieved by the mixing of polylactide and polyvinyl alcohol, typically comprising 1 to 35% by weight polylactide and from 65% to 99% by weight of polyvinyl alcohol. The polymer present in the film may be from 60% to 98% hydrolysed, more preferably from 80% to 90%, to improve the dissolution/dispersion of the film material.

The water-soluble or dispersible film herein may comprise additive ingredients other than the polymer or copolymer material. For example, it may be beneficial to add: plasticisers such as glycerol, ethylene glycol, diethyleneglycol, propylene glycol, sorbitol and mixtures thereof; additional water; and/or disintegrating aids.

Other suitable examples of commercially available water-soluble films include polyvinyl alcohol and partially hydrolysed polyvinyl acetate, alginates, cellulose ethers such as carboxymethylcellulose and methylcellulose, polyethylene oxide, polyacrylates and combinations of these. Most preferred are films with similar properties to the polyvinyl alcohol comprising film known under the trade reference M8630, sold by Monosol of Merrillville, Ind., US.

Process of Making:

The present invention also provides for a preferred process of making a non-aqueous composition of the present invention, comprising the steps of (i) providing a cationic polymer dispersion by combining the cationic polymer with the dispersant and (ii) combining the cationic polymer dispersion with a non-aqueous liquid feed. Preferably, the cationic polymer dispersion comprises from 1% to 35%, more preferably from 10% to 25% by weight of the cationic polymer. Since the cationic polymer is in particulate form, the viscosity of the cationic polymer dispersion remains low and it can be easily incorporated into the non-aqueous liquid feed by typical mixing methods. The non-aqueous feed may comprise some or all of the remaining ingredients, including anionic and/or nonionic surfactants. In one embodiment, the cationic polymer dispersion additionally comprises water and/or a solvent such that the cationic polymer is partially hydrated or solvated. If present, the water and/or solvent are preferably present at a level of from 1% to 50% by weight of the cationic polymer dispersion. In another embodiment, the process may include a step of forming an external structurant premix, and combining the external structurant premix with the cationic polymer dispersion, or the non-aqueous feed, or the combined cationic polymer dispersion/non-aqueous feed.

The non-aqueous liquid composition can be comprised in a unit dose article. Such unit dose article can be prepared according to methods known in the art. For instance, the water-soluble or dispersible film is cut to an appropriate size, and then folded to form the necessary number and size of compartments. The edges are then sealed using any suitable technology, for example heat sealing, wet sealing or pressure sealing. Preferably, a sealing source is brought into contact with said film, and heat or pressure is applied to seal the film material.

The water soluble or dispersible film is typically introduced to a mould and a vacuum applied so that said film is flush with the inner surface of the mould, thus forming an indent or niche in said film material. This is referred to as vacuum-forming. Another suitable method is thermo-forming. Thermo-forming typically involves the step of forming a water-soluble or dispersible film in a mould under application of heat, which allows said film to deform and take on the shape of the mould.

Typically more than one piece of water-soluble or dispersible film material is used for making the unit dose article. For example, a first piece of film material can be vacuum pulled into the mould so that said first piece of film material is flush with the inner walls of the mould. A second piece of film material can then be positioned such that it completely overlaps with the first piece of film material. The first piece of film material and second piece of film material are sealed together. The first and second pieces of water-soluble or dispersible film can be made of the same material or can be different materials.

In a process for preparing a multi-compartment unit dose article, a piece of water-soluble or dispersible film material is folded at least twice, or at least three pieces of film material are used, or at least two pieces of film material are used wherein at least one piece of film material is folded at least once. The third piece of film material, or a folded piece of film material, creates a barrier layer that, when the film materials are sealed together, divides the internal volume of the unit dose article into two or more compartments.

A multi-compartment unit dose article may also be prepared by fitting a first piece of film material into a mould. A composition, or component thereof, can then be poured into the mould.

A pre-formed compartment can then be placed over the mould containing the composition, or component thereof. The pre-formed compartment also preferably contains a composition, or component thereof. The pre-formed compartment and said first piece of water-soluble or dispersible film material are sealed together to form the multi-compartment unit dose article.

TEST METHODS 1) pH Measurement:

The pH is measured on the neat composition, at 25° C., using a Santarius PT-10P pH meter with gel-filled probe (such as the Toledo probe, part number 52 000 100), calibrated according to the instruction manual.

2) Hansen Solubility Parameter:

The Hansen Solubility Parameter is a three component measuring system that includes a dispersion force component ($\delta_d$), a hydrogen bonding component ($\delta_h$), and a polar component ($\delta_p$). The Hansen Solubility Parameter "δ" is derived from the fact that the total cohesive energy, which is the energy required to break all the cohesive bonds, is the combination of the dispersion forces (d), the molecular dipole forces (p), and the hydrogen bonding forces (h) according to the following equation:

$$\delta^2=\delta_d^2+\beta_p^2+\delta_h^2. \quad (1)$$

Dispersion forces are weak attractive forces between non-polar molecules. The magnitude of these forces depends on the polarizability of the molecule, and the dispersion Hansen Solubility Parameter, $\delta_d$, typically increases with increasing volume (and size) of the molecule, all other properties being roughly equal. The parameter "$\delta_p$" increases with increasing polarity of the molecule.

Hansen Solubility Parameters are calculated at 25° C. with ChemSW's Molecular Modeling Pro v.6.1.9 software package which uses an unpublished proprietary algorithm that is based on values published in the Handbook of Solubility Parameters and Other Parameters by Allan F. M. Barton (CRC Press, 1983) for solvents obtained experimentally by Hansen. All values of the Hansen Solubility Parameter reported herein are in units of $MPa^{0.5}$ (square root of megaPascals). Hansen originally determined the solubility parameter of solvents for polymer solutions.

3) Method of Measuring Particle Size:

The Occhio Flow Cell FC200-S (Angleur, Belgium) is used to measure the particle size distribution. The sample containing the particles to be analysed is diluted to 2% by weight, using PEG200, to ensure single particle detection. 2 ml of the diluted sample is analysed according to the instructions provided with the device.

4) Method of Measuring the Solubility of Water-Soluble or Dispersible Films:

5.0 grams±0.1 gram of the water-soluble or dispersible film is added in a pre-weighed 400 ml beaker and 245 ml±1 ml of distilled water is added. This is stirred vigorously on a magnetic stirrer set at 600 rpm, for 30 minutes. Then, the mixture is filtered through a sintered-glass filter with a pore size of maximum 20 microns. The water is dried off from the collected filtrate by any conventional method, and the weight of the remaining material is determined (which is the dissolved or dispersed fraction). Then, the percentage solubility or dispersibility can be calculated.

5) Method of Measuring the Dissolution Time of Water-Soluble or Dispersible Films:

The film is cut and mounted into a folding frame slide mount for 24 mm by 36 mm diapositive film, without glass (part number 94.000.07, supplied by Else, The Netherlands, however plastic folding frames from other suppliers may be used).

A standard 600 ml glass beaker is filled with 500 ml of city water at 10° C. and agitated using a magnetic stirring rod such that the bottom of the vortex is at the height of the 400 ml graduation mark on the beaker.

The slide mount is clipped to a vertical bar and suspended into the water, with the 36 mm side horizontal, along the diameter of the beaker, such that the edge of the slide mount is 5 mm from the beaker side, and the top of the slide mount is at the height of the 400 ml graduation mark. The stop watch is started immediately the slide mount is placed in the water, and stopped when the film fully dissolves. This time is recorded as the "film dissolution time".

EXAMPLES

Examples 1 to 16 are embodiments of the present invention that have good stability and provide excellent softness benefit. These embodiments were either fully stable, or exhibited slight settling with the cationic polymer in particulate form being easily redispersed by gentle shaking—even after aging at 35° C. for 4 weeks.

| Ingredient | Ex 1 WT % | Ex 2 WT % | Ex 3 WT % | Ex 4 WT % | Ex 5 WT % | Ex 6 WT % | Ex 7 WT % |
|---|---|---|---|---|---|---|---|
| Polymer LK400[1] | 10 | 14.5 | — | — | 15 | 15 | 15 |
| Polymer LR400[1] | — | — | 16 | — | — | — | — |
| Polymer JR30M[1] | — | — | — | 13 | — | — | — |
| Pluriol E200 (Polyethylenglycol 200) | 90 | 82 | 81.5 | — | 45 | 75 | 84 |
| Pluriol E400 (Polyethylenglycol 400) | — | — | — | 84 | — | — | — |
| 1,2 propanediol[2] | — | — | — | — | 40 | — | — |
| Acusol OP301[5] | — | 3.5 | 2.5 | 3 | — | — | — |
| Citric acid | — | — | — | — | — | — | 1 |
| Water | — | — | — | — | — | 10 | — |

| Ingredient | Ex 8 WT % | Ex 9 WT % | Ex 10 WT % | Ex 11 WT % | Ex 12 WT % | Ex 13 WT % | Ex 14 WT % | Ex 15 WT % | Ex 16 WT % |
|---|---|---|---|---|---|---|---|---|---|
| Linear alkyl benzene sulfonic acid | — | — | — | 15 | 13 | 16 | 14 | 15 | 16 |
| C12-14 Alkyl 3-ethoxylated sulphate acid | — | — | — | 7 | 7.5 | 6 | 12 | 7.5 | 6 |
| C12-14 alkyl 7-ethoxylate | — | 5 | 10 | 10 | 11 | 10.5 | 0.5 | 11 | 10 |
| Citric acid | — | — | — | 0.5 | 0.5 | 0.5 | — | 0.5 | 0.5 |
| Polymer LK400[1] | 15 | 15 | 15 | 6.5 | — | — | — | — | — |
| Polymer LR400[1] | — | — | — | — | 6 | — | — | — | — |
| Polymer JR30M[1] | — | — | — | — | — | 7 | — | — | — |
| Quaternium LM200[1] | — | — | — | — | — | — | 5 | — | — |
| Jaguar C13[3] | — | — | — | — | — | — | — | 5.5 | — |
| Lupasol SK[4] | — | — | — | — | — | — | — | — | 7 |
| Pluriol E200 (Polyethylenglycol 200) | 80 | 80 | 45 | 35.5 | 30.5 | 45 | 35.5 | 30 | 44 |
| l,2 propanediol[2] | — | — | 26.5 | 20 | 26.5 | 12 | 20 | 25 | 13.5 |
| Acusol OP301[5] | — | — | — | 2 | 1.5 | 3 | 1.5 | 2 | 3 |
| Hydrogenated castor oil (HCO) [6] | — | — | 3.5 | 3.5 | 3.5 | 3.5 | 3.5 | 3.5 | 3.5 |
| C12/14 Alkyl Dimethyl Amine Oxide | 5 | — | — | — | — | — | — | — | — |

[1]Supplied by Dow Chemicals, Edgewater, NJ
[2]1,2 propanediol has a Hansen parameter of 30.3
[3]Rhodia, Inc of Cranbury NJ
[4]BASF Corporation, North Mount Olive, NJ
[5]40 wt % dispersion of a styrene/acrylate copolymer, having an average particle size of 0.17 microns
[6] introduced via an external structurant system premix The presence of suitable spacer particles results in smaller cationic polymer particles, and also inhibits the cationic polymer particles from agglomerating. For example, Example 2, where the presence of 3.5% by weight Acusol OP301 (comprising 40% by weight of styrene/acrylate copolymer particles of size 0.17 microns), leads to an area average D90 of 18 microns for the cationic polymer particle. This compares to an area average D90 of 56 microns for the cationic polymer particles of example 1.

In contrast to examples 1 to 16, the comparative examples 1 to 5 are unstable. In comparative example 1, the cationic polymer in particulate form settles in less than a day, forming sediment that could not be fully redispersed with gentle agitation. Comparative examples 2 to 4 formed an unprocessible, highly viscous, paste immediately upon making. Comparative example 5 was also highly viscous and difficult to process, with the cationic polymer particles sedimenting and forming lumps that could not be redispersed by shaking or remixing.

| Ingredient | Comparative example 1 WT % | Comparative example 2 WT % | Comparative example 3 WT % | Comparative example 4 WT % | Comparative example 5 WT % |
|---|---|---|---|---|---|
| C12-14 alkyl 7-ethoxylate | — | 85 | 85 | 45 | 80 |
| Citric acid | — | — | — | — | 1.5 |

-continued

| Ingredient | Comparative example 1 WT % | Comparative example 2 WT % | Comparative example 3 WT % | Comparative example 4 WT % | Comparative example 5 WT % |
|---|---|---|---|---|---|
| Polymer LK400[1] | 15 | 15 | — | 15 | 15 |
| Isopropanol[5] | 85 | — | — | — | — |
| Hydrogenated castor oil (HCO) [4] | — | — | — | — | 3.5 |
| Water | — | — | 15 | 40 | — |

[1]Supplied by Dow Chemicals
[4] introduced via external structurant system premix
[5]Isopropanol has a Hansen parameter of 30.3

The non-aqueous liquid compositions of examples 1 to 16 can also be encapsulated in a water-soluble film (such as M8630, supplied by Monosol), to form stable liquid-comprising unit dose articles of the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-aqueous liquid composition comprising:

a) a cationic polymer in particulate form, wherein the cationic polymer in particulate form has an area average D90 diameter of less than about 300 microns, and wherein the cationic polymer is a cationic polysaccharide; and b) a non-aqueous dispersant; and c) less than 15% by weight of water;

wherein the cationic polymer is stably dispersed in the non-aqueous liquid composition, and wherein the non-aqueous liquid composition is enclosed in a water-soluble or dispersible film.

2. The non-aqueous liquid composition according to claim 1, wherein the cationic polymer in particulate form is partially hydrated and/or solvated.

3. The non-aqueous liquid composition according to claim 1, wherein the cationic polymer in particulate form has an area average D90 diameter of less than about 200 microns.

4. The non-aqueous liquid composition according to claim 1, wherein the cationic polysaccharide is a cationic cellulose having the structural formula I:

Structural Formula I

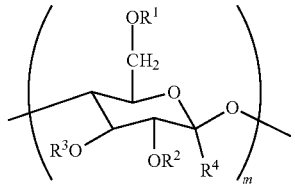

wherein:

a. m is an integer from about 20 to 10,000 b. each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

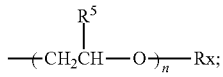

wherein:

n is an integer selected from 0 to 10 and

Rx is selected from the group consisting of: $R_5$;

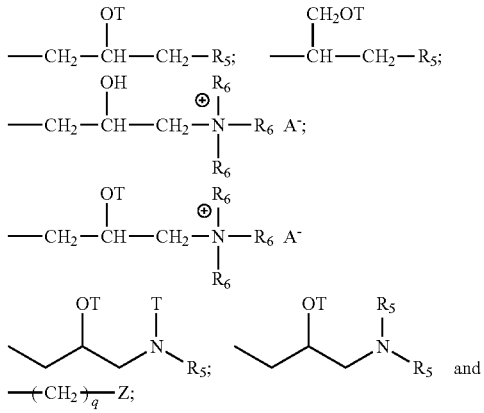

wherein at least one Rx in said polysaccharide has a structure selected from the group consisting of:

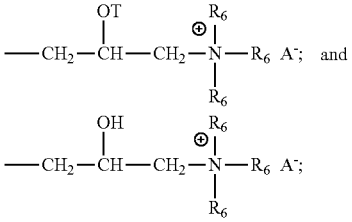

wherein $A^-$ is a suitable anion;

q is an integer selected from 1 to 4;

each $R_5$ is independently selected from the group consisting of: H; $C_1$-$C_{32}$ alkyl;

$C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH;

each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

each T is independently selected from the group: H,

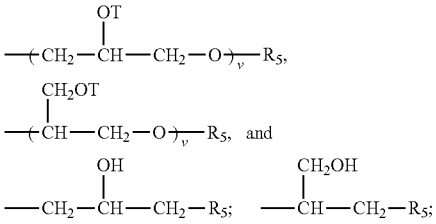

wherein each v in said polysaccharide is an integer from 1 to 10; the sum of all v indices in each Rx in said polysaccharide is an integer from 1 to 30; and in the last

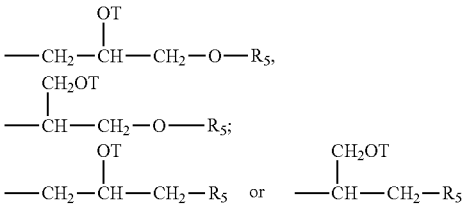

group in a chain, T is always an H.

5. The non-aqueous liquid composition according to claim 1, comprising from about 0.01% to about 20% by weight of the cationic polymer in particulate form.

6. The non-aqueous liquid composition according to claim 1, comprising from about 0.01% to about 20% by weight of the cationic polymer in particulate form.

7. The non-aqueous liquid composition according to claim 1, comprising from about 0.05% to about 98% by weight of the non-aqueous dispersant.

8. The non-aqueous liquid composition according to claim 1, wherein the non-aqueous dispersant has a Hansen parameter of from about 23 to about 36.

9. The non-aqueous liquid composition according to claim 1, wherein the non-aqueous dispersant is an alcohol or polyol selected from the group consisting of: ethanol, glycerol, polyethylene glycol of molecular weight from about 100 to about 400.

10. The non-aqueous liquid composition according to claim 1, wherein the composition further comprises from about 0.1% to about 30% by weight of spacer particles.

11. The non-aqueous liquid composition according to claim 10, wherein the spacer particles have an area average D90 diameter of less than about 5 microns.

12. The non-aqueous liquid composition according to claim 1, wherein the composition further comprises alkyltrimethylammonium salts, polyvalent anions, or mixtures thereof.

13. The non-aqueous liquid composition according to claim 12, wherein the composition comprises an alkyltrimethylammonium salt selected from the group consisting of: such as C12 alkyltrimethylammonium chloride, or their hydroxyalkyl substituted analogues.

14. The non-aqueous liquid composition according to claim 12, wherein the composition comprises polyvalent anions, selected from the group consisting of: Citric Acid; Diethylene triamine pentaacetic acid (DTPA); 1-hydroxyethane 1,1-diphosphonic acid (HEDP); Maleic acid; Polyacrylates; Polyacrylic/maleic acid copolymers; succinic acid, and mixtures thereof.

15. The non-aqueous liquid composition according to claim 1, wherein the composition further comprises from about 0.01% to about 10% by weight of an external structuring system.

16. A non-aqueous liquid composition according to claim 15, wherein the external structuring system comprises non-polymeric crystalline hydroxy-functional structurants.

17. A non-aqueous liquid composition according to claim 15, wherein the external structuring system comprises polymeric structurants.

18. The non-aqueous liquid composition according to claim 1, wherein the water-soluble or dispersible film comprises resins selected from the group consisting of: polyvinyl alcohols, polyvinyl alcohol copolymers, hydroxypropyl methyl cellulose (HPMC), and mixtures thereof.

19. A non-aqueous liquid composition according to claim 1, wherein the composition further comprises from 1% to 70% by weight of one or more anionic surfactants.

20. A process for preparing the non-aqueous liquid composition of claim 1, characterized in that the process comprises the steps of:

a. providing a cationic polymer dispersion by combining the cationic polymer with the dispersant; and b. combining the cationic polymer dispersion with a non-aqueous liquid feed.

21. A non-aqueous liquid composition comprising:

a. a cationic polysaccharide in particulate form, wherein the cationic polysaccharide in particulate form has an area average D90 diameter of less than about 300 microns; and b. a non-aqueous dispersant; and c. less than 15% by weight of water;

d. from 1% to 70% by weight of one or more anionic surfactants;

wherein the cationic polysaccharide is stably dispersed in the non-aqueous liquid composition and further wherein the cationic polysaccharide is a cationic cellulose having the structural formula I:

Structural Formula I

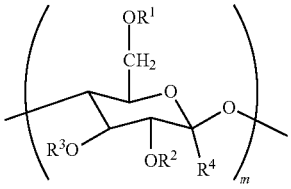

wherein:

i. m is an integer from about 20 to 10,000 ii. each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

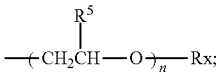

wherein:

n is an integer selected from 0 to 10 and

Rx is selected from the group consisting of: $R_5$;

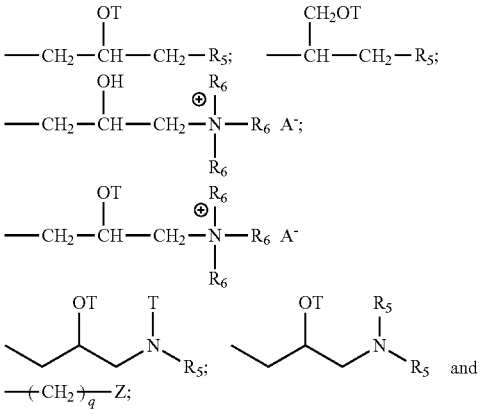

wherein at least one Rx in said polysaccharide has a structure selected from the group consisting of:

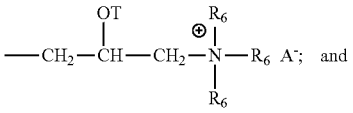

-continued

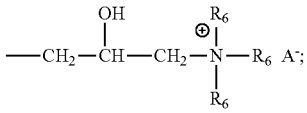

wherein $A^-$ is a suitable anion;

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH;

each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

each T is independently selected from the group: H,

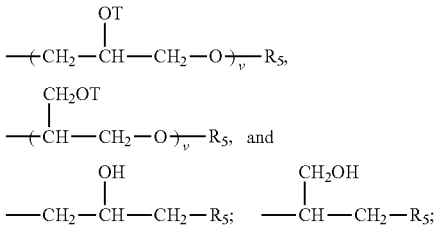

wherein each v in said polysaccharide is an integer from 1 to 10; the sum of all v indices in each Rx in said polysaccharide is an integer from 1 to 30; and in the last

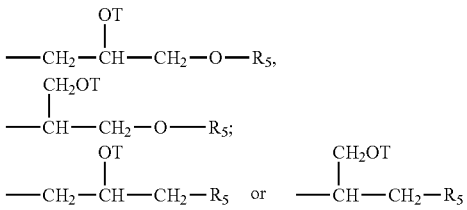

group in a chain, T is always an H;

and where the non-aqueous liquid composition is enclosed in a water-soluble or dispersible film.

* * * * *